US008222980B2

(12) United States Patent
Yamagata et al.

(10) Patent No.: US 8,222,980 B2
(45) Date of Patent: Jul. 17, 2012

(54) SEALED CONTACT DEVICE

(75) Inventors: Katsutoshi Yamagata, Obihiro (JP); Tsukasa Nishimura, Kato-gun (JP); Ritu Yamamoto, Kyotanabe (JP); Katumi Yositani, Watarai-gun (JP); Masahiro Ito, Ise (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/145,643

(22) PCT Filed: Jan. 18, 2010

(86) PCT No.: PCT/IB2010/000065

§ 371 (c)(1),
(2), (4) Date: Oct. 4, 2011

(87) PCT Pub. No.: WO2010/084395

PCT Pub. Date: Jul. 29, 2010

(65) Prior Publication Data

US 2012/0139670 A1 Jun. 7, 2012

(30) Foreign Application Priority Data

Jan. 21, 2009 (JP) ..... 2009-011131
Apr. 24, 2009 (JP) ..... 2009-107040

(51) Int. Cl.
*H01H 67/02* (2006.01)

(52) U.S. Cl. ..... 335/126; 335/131; 335/133

(58) Field of Classification Search ..... 335/126, 335/131, 133
See application file for complete search history.

(56) References Cited

U.S. PATENT DOCUMENTS 4,638,275 A * 1/1987 Belbel et al. ..... 335/151
5,103,107 A * 4/1992 Yamamoto et al. ..... 290/48
7,982,564 B2 * 7/2011 Farrar et al. ..... 335/126

FOREIGN PATENT DOCUMENTS

JP s57-44932 3/1982
JP 11-238443 8/1999
JP 2005-071915 3/2005

* cited by examiner

*Primary Examiner* — Elvin G Enad
*Assistant Examiner* — Alexander Talpalatskiy
(74) *Attorney, Agent, or Firm* — Bacon & Thomas, PLLC

(57) ABSTRACT

A sealed contact device includes an electromagnet block 2 including a coil bobbin 21, a movable iron core 25, a yoke 26, and a return spring 27; a contact block 3 including a sealing container 31, fixed contact points 32, a movable contact member 35 arranged within the sealing container 31 and composed of a rectangular body portion 35*a*, first and second protrusions 35*b*, 35*c* formed in longitudinal sides of the body portion 35*a* and movable contact points 34, and a shaft 37; and a case 4. The first and second protrusions 35*b*, 35*c* of the movable contact member 35 are formed in non-point symmetry with respect to a connection portion of the movable contact member 35 and the shaft 37 so that, when the movable contact member 35 is rotated, only one of the first and second protrusions 35*b*, 35*c* makes contact with the sealing container 31.

7 Claims, 15 Drawing Sheets

SEALED CONTACT DEVICE

FIELD OF THE INVENTION

The present invention relates to a sealed contact device.

BACKGROUND OF THE INVENTION

There is conventionally available a sealed contact device B which includes, as shown in FIGS. 8A, 8B, 9A, 9B and 10A through 10C, a hollow box-shaped case 4 and an inner block 1 arranged within the case 4, the inner block 1 having an electromagnet block 2 and a contact block 3 combined together (see, e.g., Japanese Patent Application Publication No. H11-238443). In the description given below, an up-down direction, a left-right direction and a front-rear direction orthogonal to the up-down direction and the left-right direction will be defined on the basis of the directions shown in FIG. 8A.

The electromagnet block 2 includes a hollow cylindrical coil bobbin 21 made of an insulating material and wound with an exciting coil 22, a pair of coil terminals 23 connected to the opposite end portions of the exciting coil 22, a stationary iron core 24 fixed to the inside of the coil bobbin 21 and magnetized by the energized exciting coil 22, a movable iron core 25 arranged within the coil bobbin 21 in an axially opposing relationship with the stationary iron core 24 so that, upon energizing and de-energizing the exciting coil 22, the movable iron core 25 can be attracted by the stationary iron core 24 and axially moved within the coil bobbin 21, a yoke 26 made of a magnetic material and arranged to surround the coil bobbin 21, and a return spring 27 arranged within the coil bobbin 21 to bias the movable iron core 25 downwards.

The contact block 3 includes a sealing container 31 formed of an insulating material and having a hollow box-shape with an open lower surface, a pair of substantially cylindrical columnar fixed terminals 33 arranged to extend through an upper surface of the sealing container 31 and provided with fixed contact points 32 on its lower surface, a movable contact member 135 arranged within the sealing container 31 and provided with movable contact points 34 for moving toward and away from the fixed contact points 32, a pressure contact spring 36 kept in contact with a lower surface of the movable contact member 135 to bias the movable contact member 135 toward the fixed contact points 32, and a shaft 37 coupled with the movable contact member 135 at its upper end and connected to the movable iron core 25 at its lower end to move together with the movable iron core 25.

The coil bobbin 21 is formed of a resin material and has a hollow cylindrical shape. The coil bobbin 21 includes upper and lower flange portions 21*a* and 21*b* and a cylinder portion 21*c*. The exciting coil 22 is wound around the outer circumference of the cylinder portion 21*c*. The inner diameter of a lower extension of the cylinder portion 21*c* is greater than the inner diameter of an upper extension thereof.

As shown in FIGS. 10B and 10C, the exciting coil 22 is connected at its opposite ends to a pair of terminal portions 121 provided in the upper flange portion 21*a* of the coil bobbin 21. Then, the exciting coil 22 is connected to the coil terminals 23 through lead lines 122 extending from the terminal portions 121, respectively.

Each of the coil terminals 23 includes a base portion 23*a* made of an electrically conductive material such as copper and connected to the lead lines 122 by soldering or other methods, and a terminal portion 23*b* arranged to extend substantially vertically from the base portion 23*a*.

As shown in FIG. 10B, the yoke 26 includes a substantially rectangular first yoke plate 26A arranged at the upper end side of the coil bobbin 21, a substantially rectangular second yoke plate 26B arranged at the lower end side of the coil bobbin 21 and a pair of third yoke plates 26C arranged to extend upwards from the left and right end portions of the second yoke plate 26B and connected to the first yoke plate 26A.

A recessed portion 26*a* is formed substantially at the center of an upper surface of the first yoke plate 26A. An insertion hole 26*c* is defined substantially at the center of the recessed portion 26*a*. A closed-bottom cylinder member 28 with an upper flange portion 28*a* is inserted into the insertion hole 26*c*. The upper flange portion 28*a* is jointed to the recessed portion 26*a*. The movable iron core 25 is formed from a magnetic material into a substantially cylindrical columnar shape and is arranged within the lower extension of the cylinder portion 28*b* of the cylinder member 28. The stationary iron core 24 is formed from a magnetic material into a substantially cylindrical columnar shape and is inserted into the cylinder portion 28*b* in an opposing relationship with the movable iron core 25.

A metal-made cap member 45 is arranged on the upper surface of the first yoke plate 26A. The cap member 45 includes a peripheral edge portion fixed to the first yoke plate 26A and a raised portion 45*a* formed substantially at the center thereof to define a space for accommodating the upper flange portion 24*a* of the stationary iron core 24. Removal of the stationary iron core 24 is prevented by the cap member 45.

A cylindrical bush 26D made of a magnetic material is fitted to a gap portion between the lower inner circumferential surface of the coil bobbin 21 and the outer circumferential surface of the cylinder member 28. The bush 26D makes up a magnetic circuit in cooperation with the yoke 26, the stationary iron core 24 and the movable iron core 25.

The return spring 27 extends through an axial insertion hole 24*b* of the stationary iron core 24. The return spring 27 makes contact with the upper surface of the movable iron core 25 at its lower end and with the lower surface of the cap member 45 at its upper end. The return spring 27 is kept compressed between the movable iron core 25 and the cap member 45, thereby resiliently biasing the movable iron core 25 downwards.

The shaft 37 is formed of a non-magnetic material to have a vertically elongated bar shape. The shaft 37 extends through an insertion hole 45*b* of the cap member 45 defined substantially at the center of the raised portion 45*a* and then through the return spring 27. The shaft 37 includes a thread portion 37*b* formed in the lower extension thereof. The thread portion 37*b* is threadedly coupled with, and connected to, an axial thread hole 25*a* of the movable iron core 25.

The movable contact member 135 includes a substantially rectangular body portion 135*a* having an insertion hole 135*d* defined substantially at the center thereof. The shaft 37 is inserted into the insertion hole 135*d*. Movement of the movable contact member 135 toward the fixed contact points 32 is restrained by a flange-shaped restraint portion 37*a* formed at the upper end of the shaft 37. As can be seen in FIG. 11A, the movable contact points 34 are fixed to the left and right end portions of the body portion 135*a*. Substantially rectangular protrusions 135*b* and 135*c* protrude from the longitudinal sides of the body portion 135*a*. The protrusions 135*b* and 135*c* are substantially in point symmetry with respect to the insertion hole 135*d*. The protrusions 135*b* and 135*c* are formed to have the same width a5 and the same protruding length b5.

The fixed terminals 33 are formed from an electrically conductive material such as copper into a substantially cylindrical columnar shape. Each of the fixed terminals 33 includes a flange portion 33*a* formed at the upper end thereof. The fixed contact points 32 are fixed to the lower surfaces of the fixed terminals 33 in an opposing relationship with the movable contact points 34. Each of the fixed terminals 33 has a thread hole 33*b* axially extending from the upper surface thereof. Thread portions of an external load device (not shown) are threadedly coupled to the thread holes 33*b* of the fixed terminals 33.

The sealing container 31 is formed from a heat-resistant material such as ceramics into a hollow box shape with an open lower surface. Two through-holes 31*a* through which the fixed terminals 33 pass are formed side by side on the upper surface of the sealing container 31. The fixed terminals 33 are inserted into the through-holes 31*a* with the flange portions 33*a* thereof positioned above the upper surface of the sealing container 31 and are jointed to the sealing container 31 by soldering. As shown in FIG. 10A, one end of a flange member 38 is jointed to the peripheral edge of an opening of the sealing container 31 by soldering. The other end of the flange member 38 is jointed to the first yoke plate 26A by soldering, whereby the sealing container 31 is sealed.

In the opening of the sealing container 31, there is provided an insulating member 39 for isolating an arc generated between the fixed contact points 32 and the movable contact points 34 from the joint portion of the sealing container 31 and the flange member 38.

The insulating member 39 is formed from an insulating material such as ceramics or a synthetic resin into a substantially hollow cuboid shape with an open upper surface. The insulating member 39 includes a rectangular rim 39*a* formed substantially at the center of the lower surface thereof. The raised portion 45*a* of the cap member 45 is fitted to a recessed portion defined within the rectangular rim 39*a*. The upper end of a peripheral wall of the insulating member 39 makes contact with the inner surface of a peripheral wall of the sealing container 31, thereby isolating the joint portion of the sealing container 31 and the flange member 38 from the contact portions including the fixed contact points 32 and the movable contact points 34.

The insulating member 39 includes a circular rim 39*c* formed substantially at the center of the inner bottom surface thereof. The inner diameter of the circular rim 39*c* is substantially equal to the inner diameter of the pressure contact spring 36. An insertion hole 39*b* through which the shaft 37 extends is formed substantially at the center of the circular rim 39*c*. The lower end of the pressure contact spring 36 through which the shaft 37 extends is fitted to a recessed portion defined within the circular rim 39*c*, thereby preventing misalignment of the pressure contact spring 36.

The pressure contact spring 36 makes contact with the lower surface of the movable contact member 135 at its upper end and remains compressed between the insulating member 39 and the movable contact member 135. Thus, the pressure contact spring 36 resiliently biases the movable contact member 135 toward the fixed contact points 32.

The case 4 is formed from a resin material into a substantially rectangular box shape. The case 4 includes a hollow box-shaped case body 41 with an open upper surface and a hollow box-shaped cover 42 arranged to cover an opening of the case body 41.

As shown in FIG. 10C, the case body 41 includes ear portions 141 formed at the front ends of the left and right side walls thereof. The ear portions 141 have insertion holes 141*a* used in attaching the sealed contact device B to an installation surface with screws. The case body 41 has a stepped portion 41*a* formed in the peripheral edge of the upper opening thereof. The outer dimension of the upper end extension of the case body 41 is smaller than the outer dimension of the lower extension thereof. A pair of slits 41*b* for insertion of the terminal portions 23*b* of the coil terminals 23 is formed in the front wall of the case body 41 above the stepped portion 41*a*. In the rear wall of the case body 41 above the stepped portion 41*a*, a pair of recessed portions 41*c* is arranged side by side along the left-right direction.

The cover 42 is formed into a hollow box shape with an open lower surface. A pair of protrusions 42*a* is formed on the rear surface of the cover 42. The protrusions 42*a* are fitted to the recessed portions 41*c* of the case body 41 when the cover 42 is mounted to the case body 41. A partition portion 42*c* for substantially bisecting the upper surface of the cover 42 into left and right areas is formed on the upper surface of the cover 42. A pair of insertion holes 42*b* for insertion of the fixed terminals 33 is formed on the upper portion of the cover 42 bisected by the partition portion 42*c*.

When the inner block 1 including the electromagnet block 2 and the contact block 3 is put into the case 4, a substantially rectangular lower cushion rubber 43 is interposed between the lower flange portion 21*b* of the coil bobbin 21 and the bottom surface of the case body 41 and an upper cushion rubber 44 having insertion holes 44*a* for insertion of the flange portions 33*a* of the fixed terminals 33 is interposed between the sealing container 31 and the cover 42.

In the conventional sealed contact device B configured as above, the return spring 27 has a spring constant higher than that of the pressure contact spring 36. Therefore, the movable iron core 25 is slid downwards by the biasing force of the return spring 27 and, concurrently, the shaft 37 is moved downwards. Since the movable contact member 135 is moved downwards together with the restraint portion 37*a* of the shaft 37, the movable contact points 34 are initially kept spaced apart from the fixed contact points 32.

If the exciting coil 22 is energized, the movable iron core 25 is attracted by the stationary iron core 24 and moved upwards. Thus, the shaft 37 connected to the movable iron core 25 is also moved upwards. As a result, the restraint portion 37*a* of the shaft 37 is moved toward the fixed contact points 32, and the movable contact member 135 is also moved toward the fixed contact points 32 by the biasing force of the pressure contact spring 36. Accordingly, the movable contact points 34 fixed to the movable contact member 135 are brought into contact with, and electrically connected to, the fixed contact points 32.

If the exciting coil 22 is de-energized, the movable iron core 25 is slid downwards by the biasing force of the return spring 27. Accordingly, the shaft 37 is also moved downwards. As a result, the restraint portion 37*a* is moved downwards together with the movable contact member 135, whereby the fixed contact points 32 and the movable contact points 34 are spaced apart from each other and electrically interrupted.

In the conventional sealed contact device B described above, the pressure contact spring 36 is kept compressed. Therefore, if the pressure contact spring 36 is extended to cause the movable contact member 135 to slide toward the fixed contact points 32, the movable contact member 135 is rotated clockwise as illustrated in FIG. 11B by the torque of the pressure contact spring 36 acting in the direction (clockwise direction) opposite to the winding direction (counter-clockwise direction) thereof. If the pressure contact spring 36 is retracted to move the movable contact member 135 away from the fixed contact points 32, the movable contact member 135 is rotated counterclockwise by the torque of the pressure contact spring 36 acting in the same direction as the winding direction thereof.

Consequently, the movable contact member 135 makes sliding movement in a state that two diagonal points of the protrusions 135*b* and 135*c* remaining in point symmetry with respect to the insertion hole 135*d* are brought into contact with, and pressed against, the inner surfaces of the sealing container 31. This leads to an increased friction force and hinders smooth movement of the movable contact member 135, which may possibly impair the reliability of a switching action between the contact points.

In general, if the contact points are electrically connected to each other, electric currents flow in the opposite directions on the surfaces of the fixed contact points 32 and on the surfaces of the movable contact points 34 opposing to the fixed contact points 32. This generates an electromagnetic repulsion force acting to move the movable contact points 34 away from the fixed contact points 32.

If the movable contact member 135 is tilted by, e.g., an unbalanced biasing force applied from one end of the pressure contact spring 36 and if the centers of the movable contact points 34 make contact with the off-centered areas of the fixed contact points 32, the electromagnetic repulsion force mentioned above acts on the movable contact member 135 as rotation torque. When the contact points are electrically connected or when the intensity of an electric current flowing between the contact points is changed sharply, the movable contact member 135 is continuously affected by the variations of the rotation torque and is vibrated about the connection portion thereof connected to the shaft 37. Abnormal noises may possibly be generated by the vibration of the movable contact member 135.

SUMMARY OF THE INVENTION

In view of the above, the present invention provides a sealed contact device capable of enabling a movable contact member to move smoothly and enhancing the reliability of a switching action between contact points.

In claim 1, there is described a sealed contact device, including: an electromagnet block including a hollow cylindrical coil bobbin made of an insulating material and wound with an exciting coil, a movable iron core arranged inside the coil bobbin to axially move within the coil bobbin upon energization and de-energization of the exciting coil, a yoke arranged to form a magnetic circuit and including a first yoke plate having an insertion hole and facing one axial end of the coil bobbin, a second yoke plate facing the other axial end of the coil bobbin and a third yoke plate interconnecting the first yoke plate and the second yoke plate, and a return spring arranged inside the coil bobbin to bias the movable iron core toward the second yoke plate;

a contact block including a sealing container made of an insulating material and air-tightly jointed to the first yoke plate, fixed contact points arranged within the sealing container, a movable contact member arranged within the sealing container and including a substantially rectangular body portion, first and second protrusions formed in longitudinal sides of the body portion and movable contact points for making movement toward and away from the fixed contact points, a pressure contact spring interposed between the movable contact member and the first yoke plate to bias the movable contact member toward the fixed contact points, and a shaft movably extending through the first yoke plate, the shaft being connected to the movable contact member at one end and to the movable iron core at the other end to move the movable contact member toward the fixed contact points in accordance with the movement of the movable iron core; and a case made of an insulating material and arranged to accommodate an inner block including the electromagnet block and the contact block combined together, wherein the first and second protrusions of the movable contact member are formed in non-point symmetry with respect to a connection portion of the movable contact member and the shaft so that, when the movable contact member is rotated, only one of the first and second protrusions makes contact with the sealing container.

With such configuration, only one of the first and second protrusions of the movable contact member makes contact with the sealing container when the movable contact member is rotated and slid in contact with the sealing container. As compared with a case where both of the first and second protrusions would make contact with the sealing container, it is possible to reduce the friction force acting between the movable contact member and the sealing container, thereby enabling the movable contact member to move smoothly and enhancing the reliability of the switching action between the contact points.

In claim 2, the movable contact member has a gravity center positioned below the connection portion of the movable contact member and the shaft in a gravitational force direction.

With such configuration, the gravity center of the movable contact member is positioned below the vibration center, i.e., the connection portion of the movable contact member and the shaft, in the gravitational force direction. This helps reduce the amplitude of vibration of the movable contact member and makes it possible to restrain generation of abnormal noises caused by the vibration.

In claim 3, the first and second protrusions are shaped and sized so that only the first protrusion makes contact with the sealing container, the gravity center of the movable contact member being positioned in the first protrusion, the first protrusion being arranged below the connection portion of the movable contact member and the shaft in the gravitational force direction.

With such configuration, the amplitude of vibration of the movable contact member is reduced. This makes it possible to restrain generation of abnormal noises caused by the vibration.

In claim 4, the first protrusion is greater in width than the second protrusion.

With such configuration, the width of the first protrusion is greater than the width of the second protrusion. Therefore, only one of the first and second protrusions of the movable contact member makes contact with the sealing container when the movable contact member is rotated and slid in contact with the sealing container. As compared with a case where both of the first and second protrusions would make contact with the sealing container, it is possible to reduce the friction force acting between the movable contact member and the sealing container, thereby enabling the movable contact member to move smoothly and enhancing the reliability of the switching action between the contact points.

In claim 5, the width of the first protrusion is set to ensure that, when the movable contact member is rotated at a predetermined angle, the first protrusion makes contact with the sealing container.

With such configuration, the rotation angle of the movable contact member is reduced. This makes it possible to reduce the pressing force of the movable contact member acting against the sealing container, thereby enabling the movable contact member to move smoothly and further enhancing the reliability of the switching action between the contact points.

In claim 6, the first protrusion is greater in protruding length than the second protrusion.

With such configuration, the protruding length of the first protrusion is greater than the protruding length of the second protrusion. Therefore, only one of the first and second protrusions of the movable contact member makes contact with the sealing container when the movable contact member is rotated and slid in contact with the sealing container. As compared with a case where both of the first and second protrusions would make contact with the sealing container, it is possible to reduce the friction force acting between the movable contact member and the sealing container, thereby enabling the movable contact member to move smoothly and enhancing the reliability of the switching action between the contact points.

In claim 7, the protruding length of the first protrusion is set to ensure that, when the movable contact member is rotated at a predetermined angle, the first protrusion makes contact with the sealing container.

With such configuration, the rotation angle of the movable contact member is reduced. This makes it possible to reduce the pressing force of the movable contact member acting against the sealing container, thereby enabling the movable contact member to move smoothly and further enhancing the reliability of the switching action between the contact points.

As set forth above, the present invention has an effect of enabling the movable contact member to move smoothly and enhancing the reliability of the switching action between the contact points.

DETAILED DESCRIPTION OF THE PREFERRED EMBODIMENTS

Hereinafter, an embodiment of the present invention will be described with reference to the accompanying drawings.

A sealed contact device A according to the present embodiment will be described with reference to FIGS. 1A, 1B, 2A, 25, 3A and 3B. In the following description, the up-down direction and the left-right direction in FIG. 1B will be defined as an up-down direction and a front-rear direction, respectively. The direction orthogonal to the up-down direction and the front-rear direction will be defined as left-right direction.

Figure 8A:
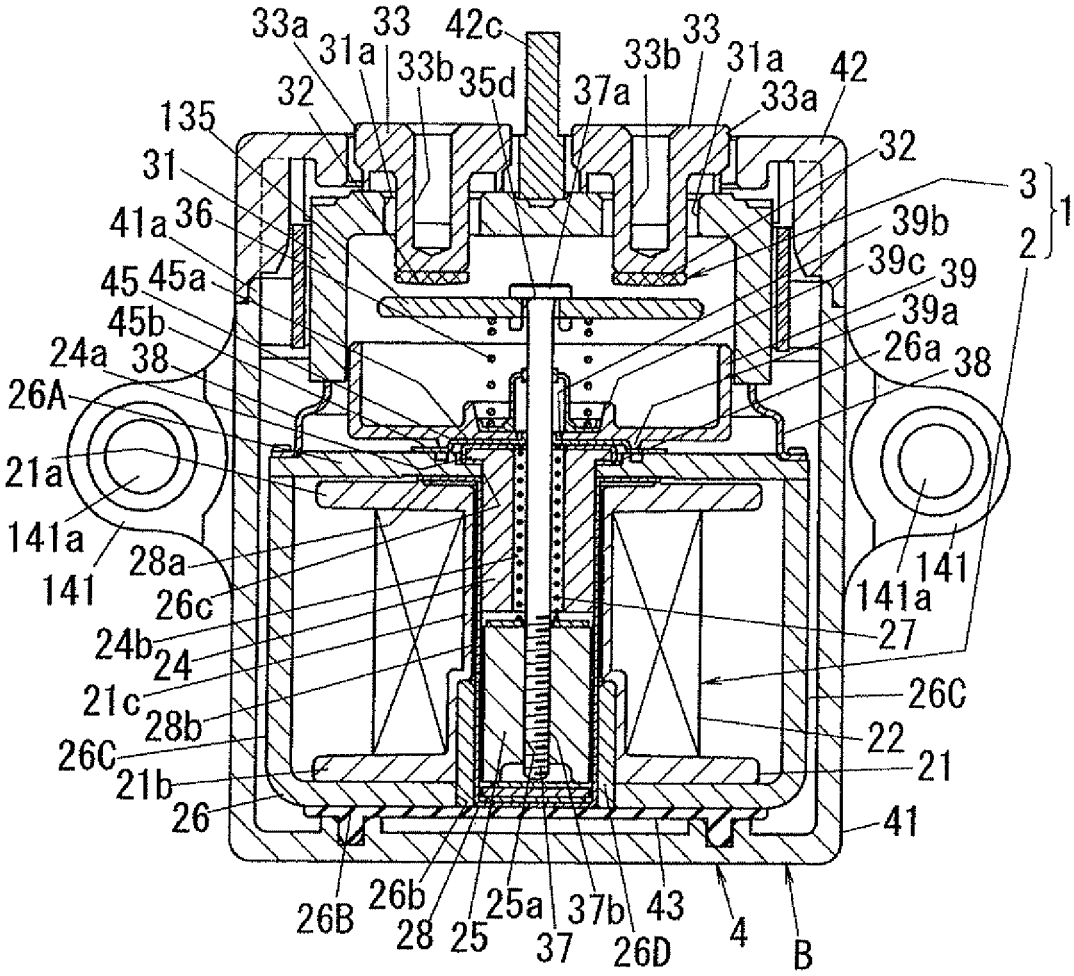
FIG. 8A (PRIOR ART)
FIG. 8A is a schematic section view showing a conventional sealed contact device.
Figure 8B:
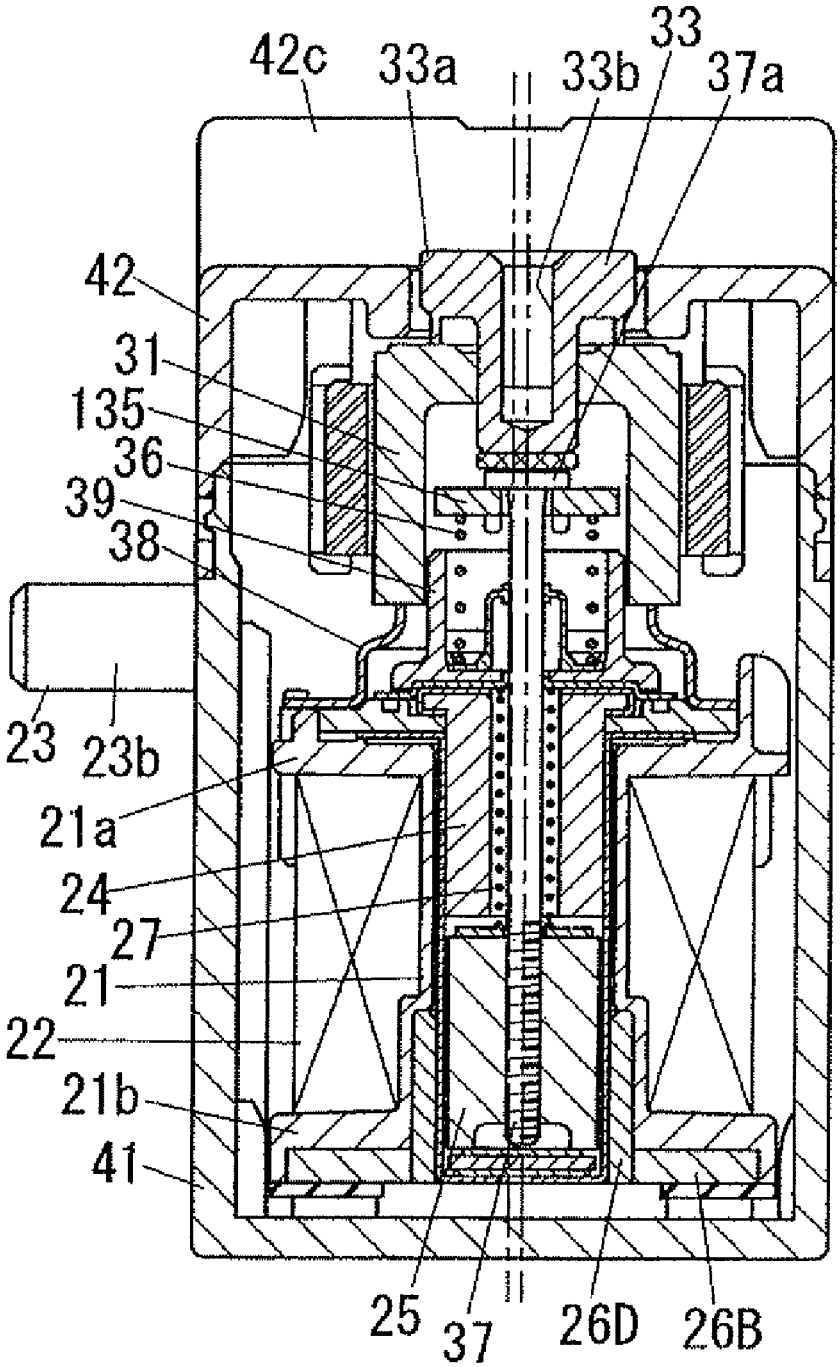
FIG. 8B (PRIOR ART)
FIG. 8B is another schematic section view of the conventional sealed contact device shown in FIG. 8A.
Figure 9A:
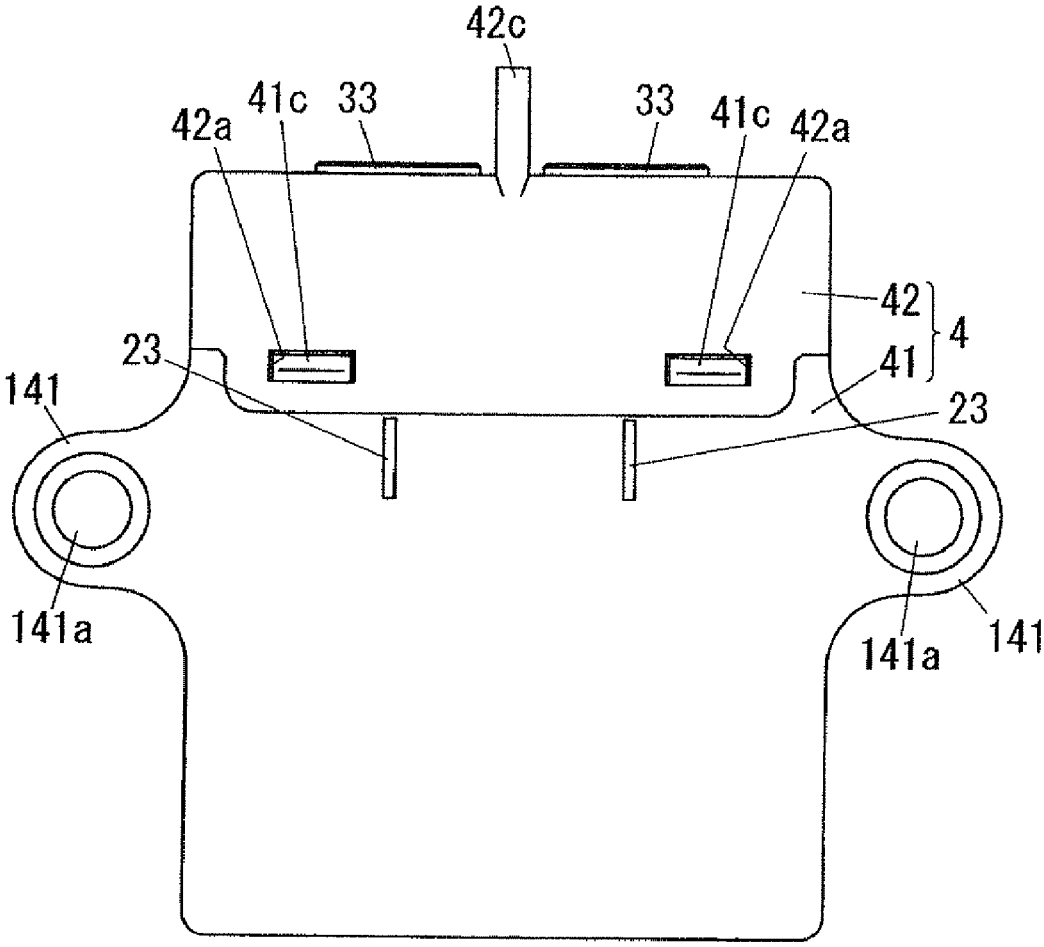
FIG. 9A (PRIOR ART)
FIG. 9A is a bottom view illustrating the outward appearance of a case of the conventional sealed contact device shown in FIG. 8A.
Figure 9B:
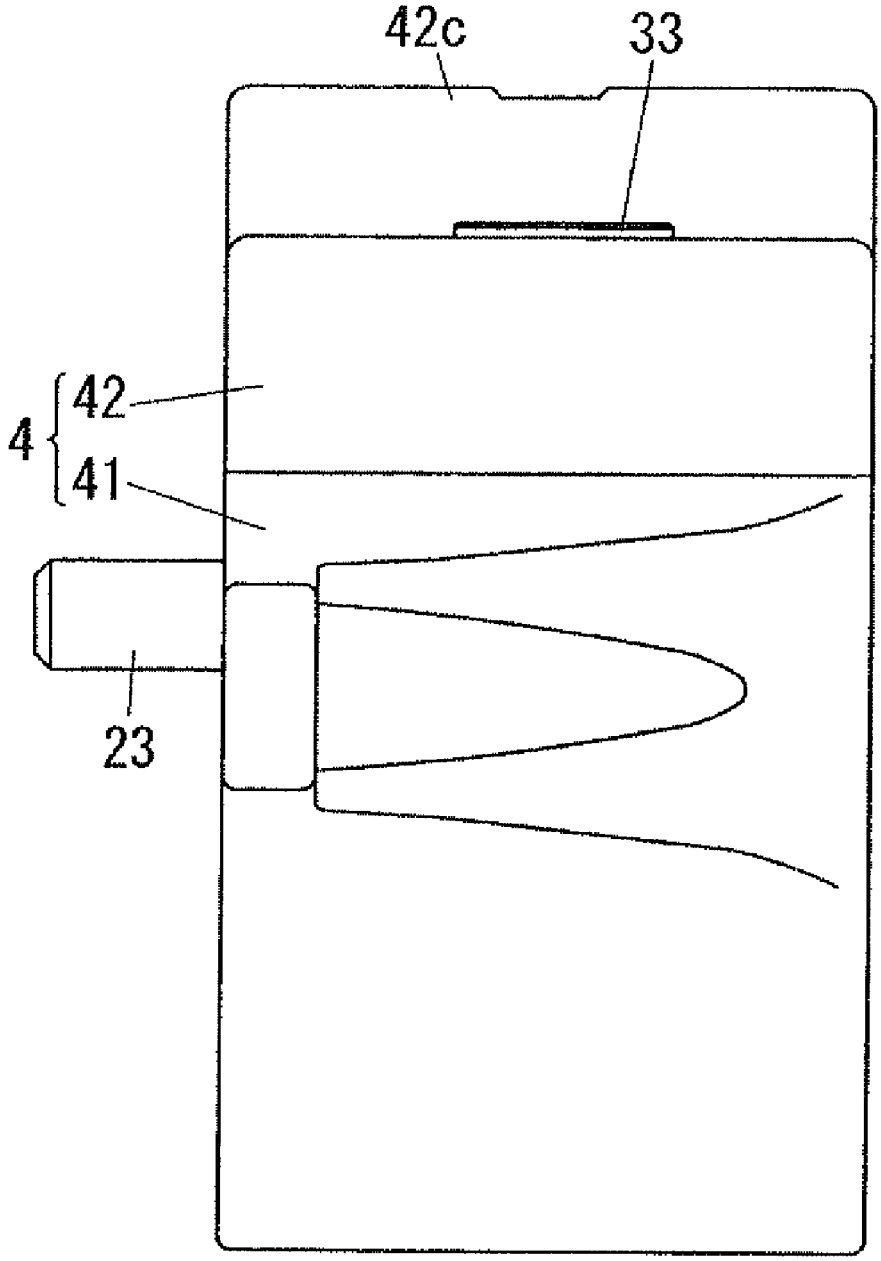
FIG. 9B (PRIOR ART)
FIG. 9B is a side view illustrating the outward appearance of the case of the conventional sealed contact device shown in FIG. 8A.
Figure 10A:
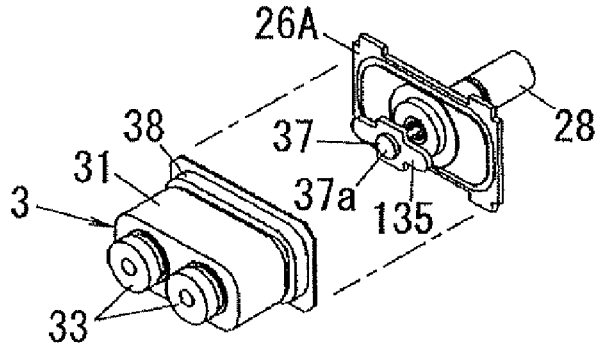
FIG. 10A (PRIOR ART)
FIGS. 10A to 10C are exploded perspective views of the conventional sealed contact device shown in FIG. 8A.
Figure 10B:
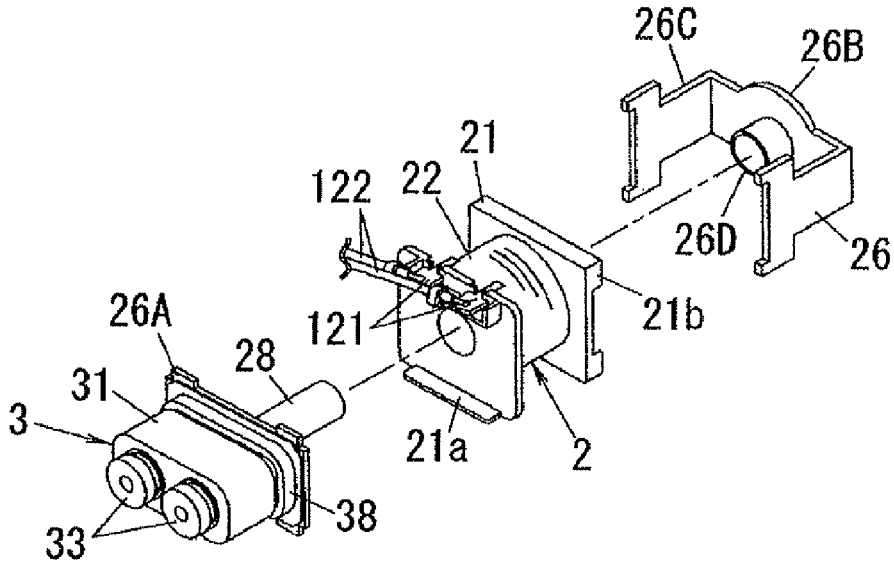
FIG. 10B (PRIOR ART)
Figure 10C:
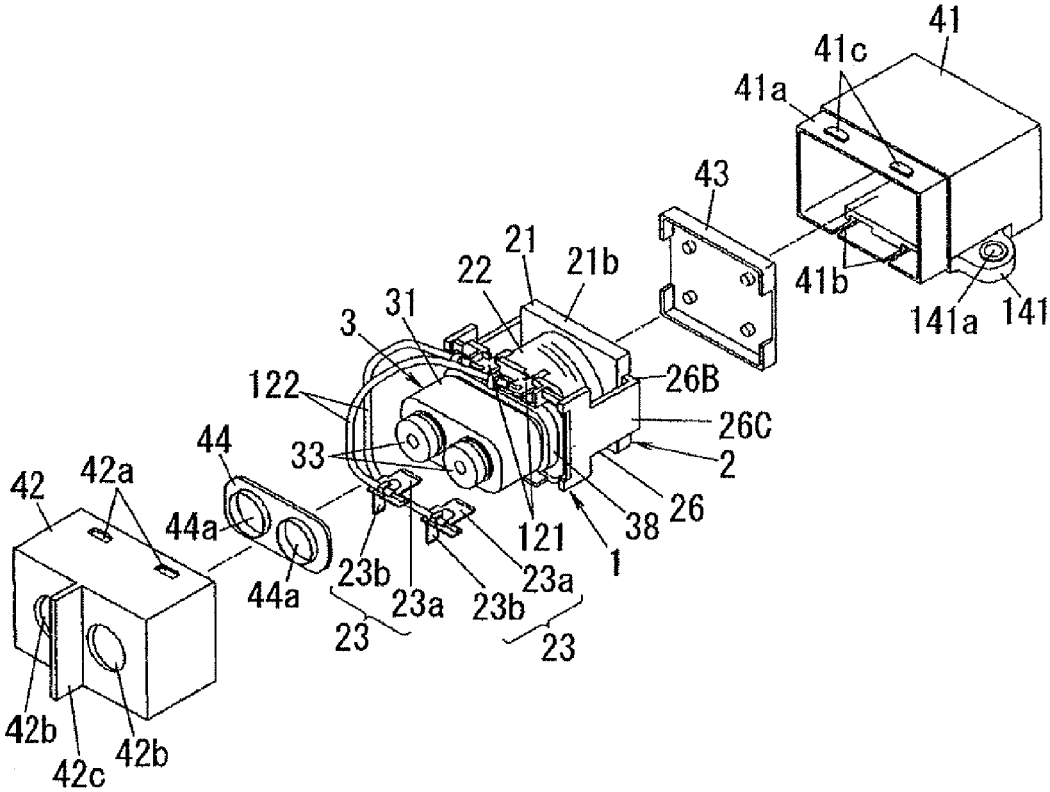
FIG. 10C (PRIOR ART)
Figure 11A:
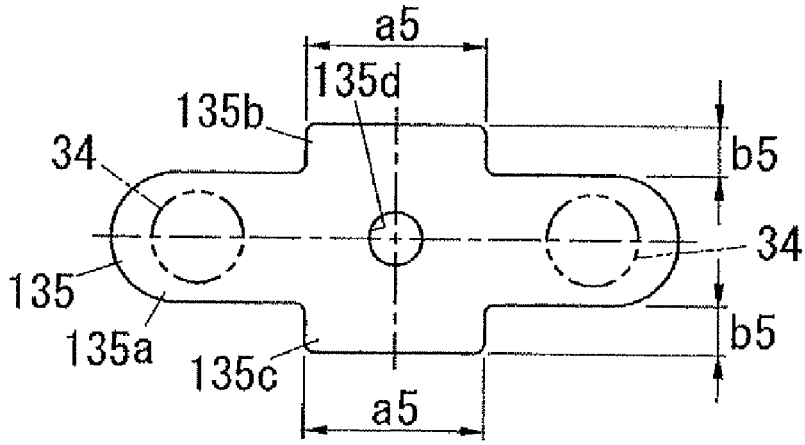
FIG. 11A (PRIOR ART)
FIG. 11A is a plan view showing a movable contact member as one of major parts of the conventional sealed contact device and FIG. 11B is a section view showing a sealing container as another major part of the conventional sealed contact device.
Figure 11B:
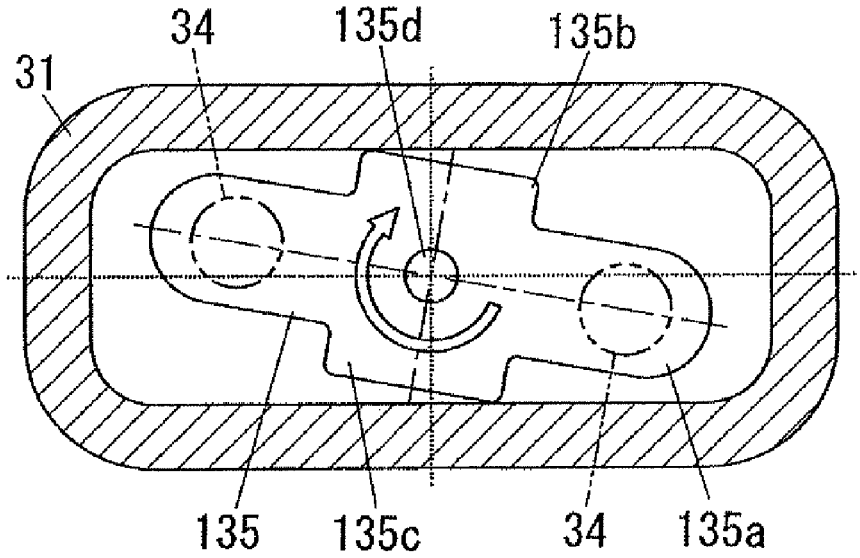
FIG. 11B (PRIOR ART)

The sealed contact device A of the present embodiment differs from the conventional sealed contact device shown in FIGS. 8A and 8B in that the sealed contact device A of the present embodiment includes a movable contact member 35 having protrusions 35*b* and 35*c* differing in shape from the protrusions 135*b* and 135*c* of the movable contact member 135 of the conventional sealed contact device.

Figure 1A:
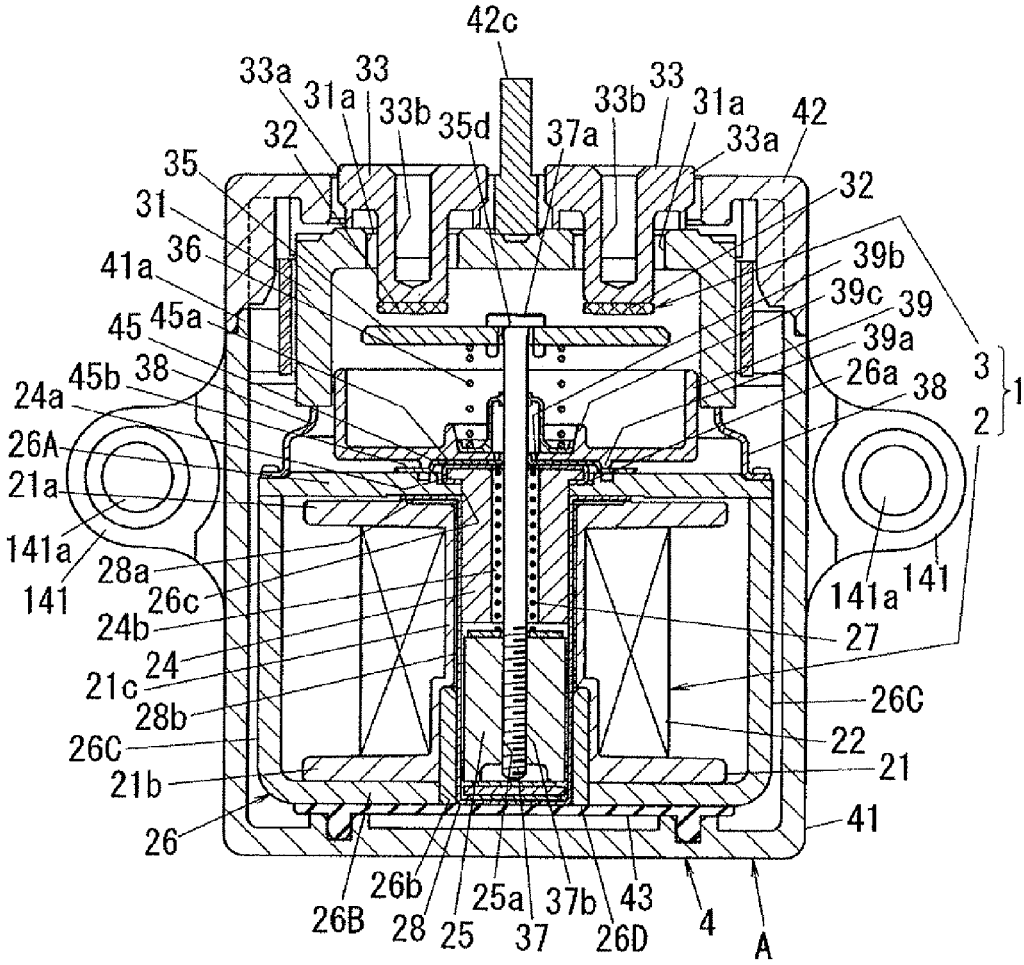
FIG. 1A is a schematic section view showing a sealed contact device in accordance with one embodiment of the present invention.
Figure 1B:
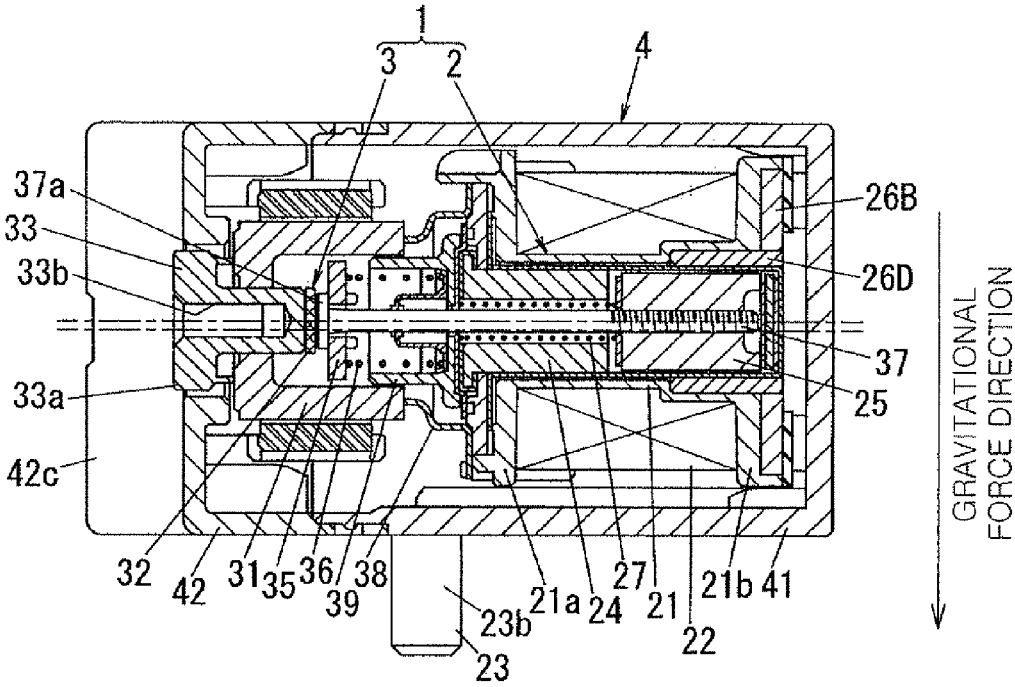
FIG. 1B is another schematic section view of the sealed contact device shown in FIG. 1A.
Figure 2A:
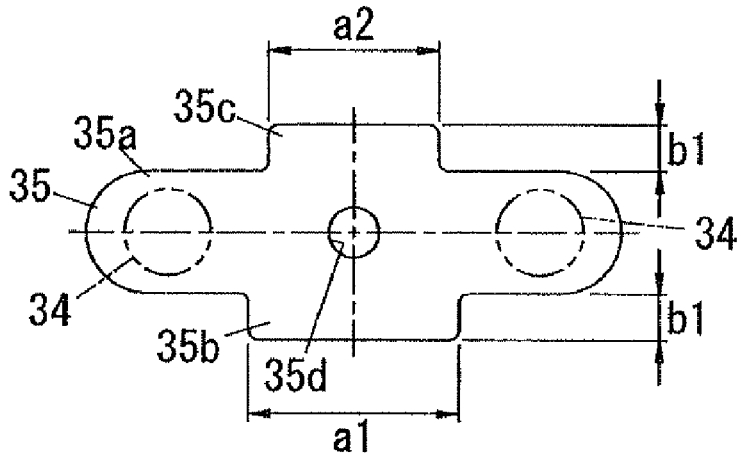
FIG. 2A is a plan view showing a movable contact member as one of major parts of the sealed contact device and FIG. 2B is a section view showing a sealing container as another major part of the sealed contact device.

Referring to FIG. 2A, the sealed contact device A of the present embodiment includes a movable contact member 35 having a body portion 35*a*, a substantially rectangular protrusion 35*b* formed in a lower longitudinal side of the body portion 35*a* and a substantially rectangular protrusion 35*c* formed in an upper longitudinal side of the body portion 35*a*. The protrusions 35*b* and 35*c* differ in left-and-right dimension (width) from each other. In other words, the width a1 of the protrusion 35*b* is greater than the width a2 of the protrusion 35*c*. The protruding length b1 of the protrusion 35*b* is equal to the protruding length b1 of the protrusion 35*c*.

Figure 2B:
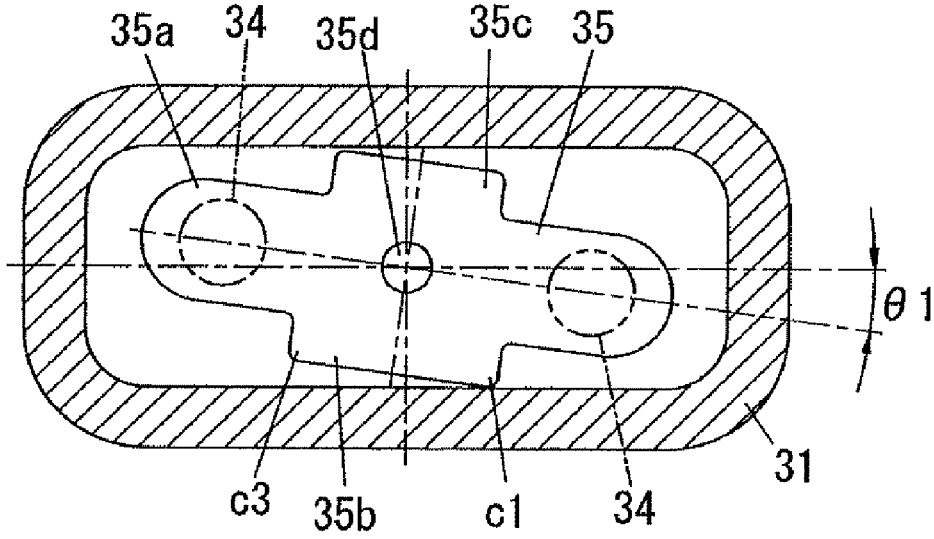

In the sealed contact device of the present embodiment configured as above, if the pressure contact spring 36 is extended, as shown in FIG. 2B, the winding torque of the pressure contact spring 36 causes the movable contact member 35 to rotate by an angle of θ1 within the sealing container 31 about the connection portion of the movable contact member 35 and the shaft 37 (the vibration center) in the direction (clockwise direction) opposite to the winding direction (counterclockwise direction) of the pressure contact spring 36. At this time, only one (right) corner portion c1 of the tip end of the protrusion 35*b* having an increased width makes contact with the inner surface of the sealing container 31. Rotation of the movable contact member 35 is stopped just when the corner portion c1 comes into contact with the sealing container 31. Therefore, the corner portions of the tip end of the protrusion 35*c* do not make contact with the sealing container 31. Only the corner portion c1 of the protrusion 35*b* is kept in contact with the sealing container 31.

Accordingly, when the movable contact member 35 is rotated, all the protrusions 35*b* and 35*c* do not make contact with the inner surface of the sealing container 31 and, instead, only one corner portion c1 of the protrusion 35*b* having an increased width makes contact with the inner surface of the sealing container 31. This reduces the frictional resistance acting between the movable contact member 35 and the sealing container 31, thereby enabling the movable contact member 35 to move smoothly and enhancing the reliability of the switching action between the contact points.

Since the width of the protrusion 35*b* is greater than the width of the protrusion 35*c*, the weight of the lower portion of the movable contact member 35 positioned below the connection portion of the movable contact member 35 and the shaft 37 (i.e., the insertion hole 35*d*) becomes greater than the weight of the upper portion of the movable contact member 35 positioned above the connection portion. In other words, the gravity center of the movable contact member 35 is positioned lower than the vibration center thereof.

Accordingly, when the movable contact member 35 vibrates in a state that the exciting coil 22 is energized with the contact points kept in contact with each other, the amplitude of vibration of the movable contact member 35 is reduced. This makes it possible to restrain generation of abnormal noises.

Figure 3A:
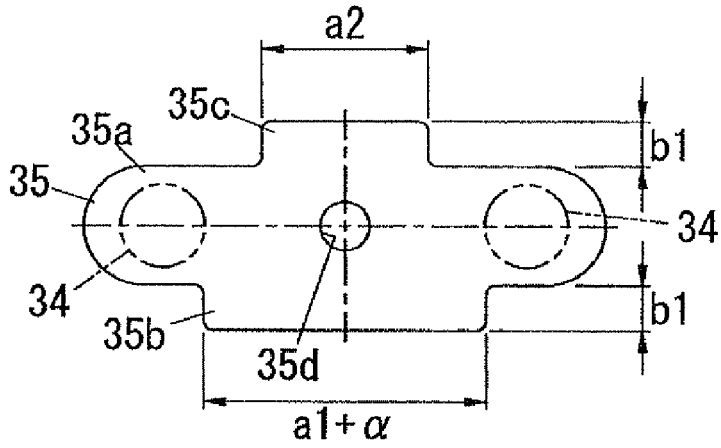
FIG. 3A is a plan view showing another example of the movable contact member and FIG. 3B is a section view showing the sealing container.
Figure 3B:
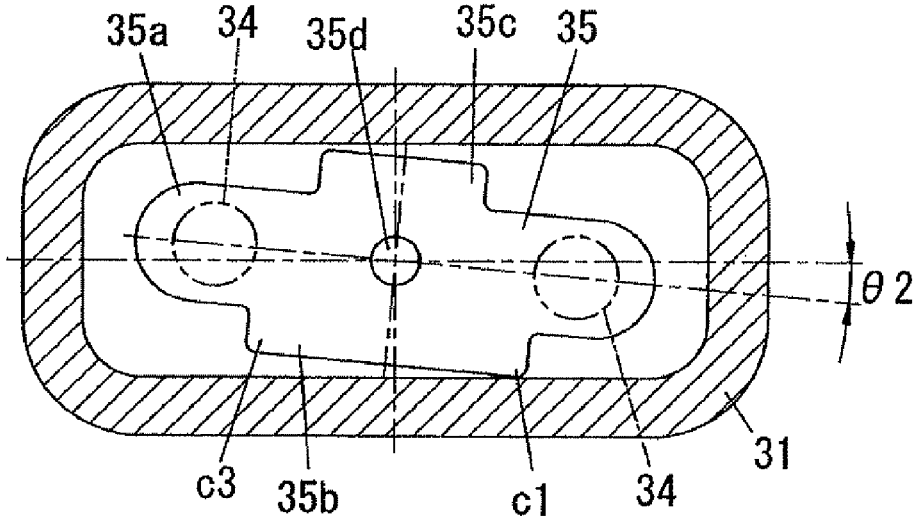

Referring to FIG. 3A which shows another example of the movable contact member 35, the width of the protrusion 35*b* is set equal to a1+α which is greater than a1 by α, This further increases the difference between the width of the protrusion 35*b* and the width a2 of the protrusion 35*c*. As shown in FIG. 3B, the rotation angle of the movable contact member 35 when the movable contact member 35 makes contact with the sealing container 31 is set equal to a predetermined angle θ2 which is smaller than θ1. Accordingly, it is possible to reduce the pressing force of the corner portion c1 of the movable contact member 35 acting against the sealing container 31. This further reduces the friction force generated between the protrusion 35*b* and the sealing container 31, thereby enabling the movable contact member 35 to move smoothly and further enhancing the reliability of the switching action between the contact points.

In addition, the weight of the lower portion of the movable contact member 35 positioned below the connection portion of the movable contact member 35 and the shaft 37 becomes even greater than the weight of the upper portion of the movable contact member 35 positioned above the connection portion. Thus, the gravity center of the movable contact member 35 is shifted further downwards along the gravitational force direction. As a result, the amplitude of vibration of the movable contact member 35 is further reduced. This makes it possible to further restrain generation of abnormal noises.

Figure 4A:
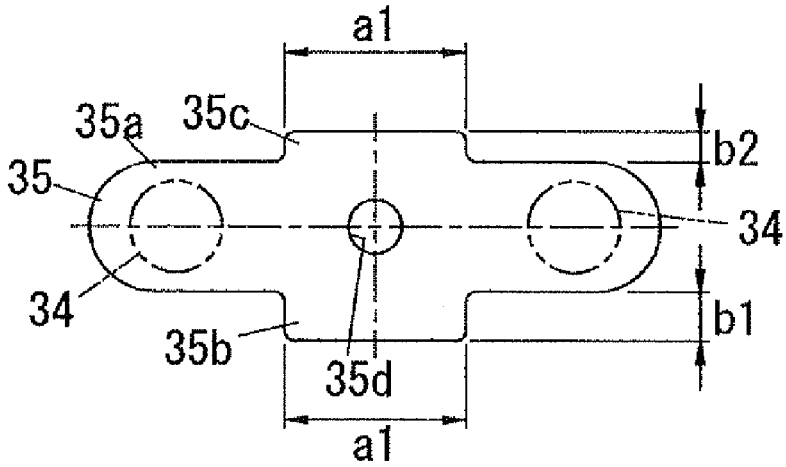
FIG. 4A is a plan view showing a further example of the movable contact member and FIG. 4B is a section view showing the sealing container.
Figure 4B:
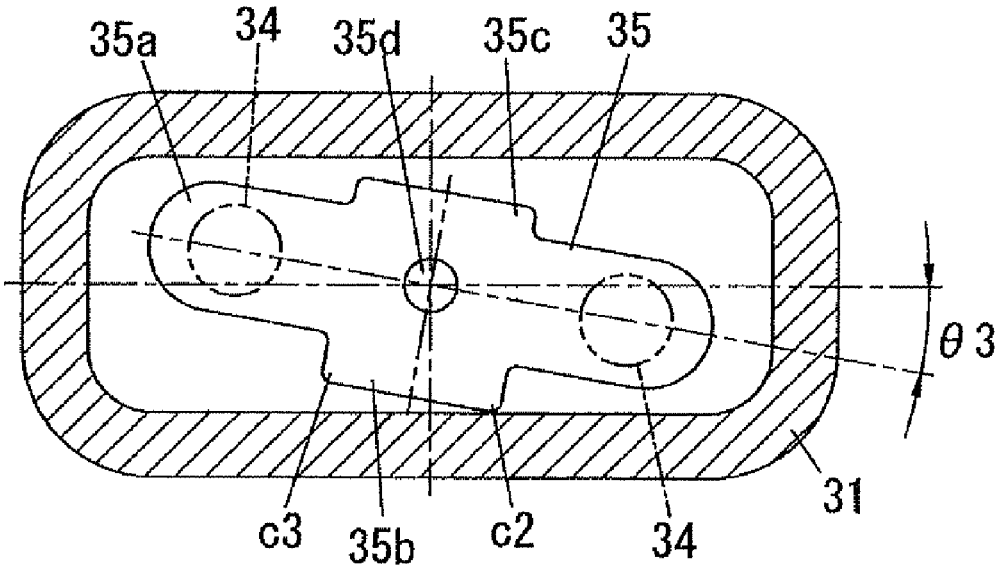

Referring to FIG. 4A which shows a further example of the movable contact member 35, the protrusions 35*b* and 35*c* have the same width a1 but the protruding length b1 of the protrusion 35*b* is greater than the protruding length b2 of the protrusion 35*c*. If the pressure contact spring 36 is extended, as shown in FIG. 4B, the winding torque of the pressure contact spring 36 causes the movable contact member 35 to rotate by an angle of θ3 within the sealing container 31 in the direction (clockwise direction) opposite to the winding direction (counterclockwise direction) of the pressure contact spring 36. At this time, only one (right) corner portion c2 of the tip end of the protrusion 35*b* having an increased protruding length makes contact with the inner surface of the sealing container 31. Rotation of the movable contact member 35 is stopped just when the corner portion c2 comes into contact with the sealing container 31. Therefore, the corner portions of the tip end of the protrusion 35*c* do not make contact with the sealing container 31. Only the corner portion c2 of the protrusion 35*b* is kept in contact with the sealing container 31.

Accordingly, when the movable contact member 35 is rotated, all the protrusions 35*b* and 35*c* do not make contact with the inner surface of the sealing container 31 and, instead, only one corner portion c2 of the protrusion 35*b* having an increased protruding length makes contact with the inner surface of the sealing container 31. This reduces the frictional resistance acting between the movable contact member 35 and the sealing container 31, thereby enabling the movable contact member 35 to move smoothly and enhancing the reliability of the switching action between the contact points.

Since the protruding length of the protrusion 35*b* is greater than the protruding length of the protrusion 35*c*, the weight of the lower portion of the movable contact member 35 positioned below the connection portion of the movable contact member 35 and the shaft 37 (i.e., the insertion hole 35*d*) becomes greater than the weight of the upper portion of the movable contact member 35 positioned above the connection portion. In other words, the gravity center of the movable contact member 35 is positioned lower than the vibration center thereof.

Accordingly, when the movable contact member 35 vibrates in a state that the exciting coil 22 is energized with the contact points kept in contact with each other, the amplitude of vibration of the movable contact member 35 is reduced. This makes it possible to restrain generation of abnormal noises.

Figure 5A:
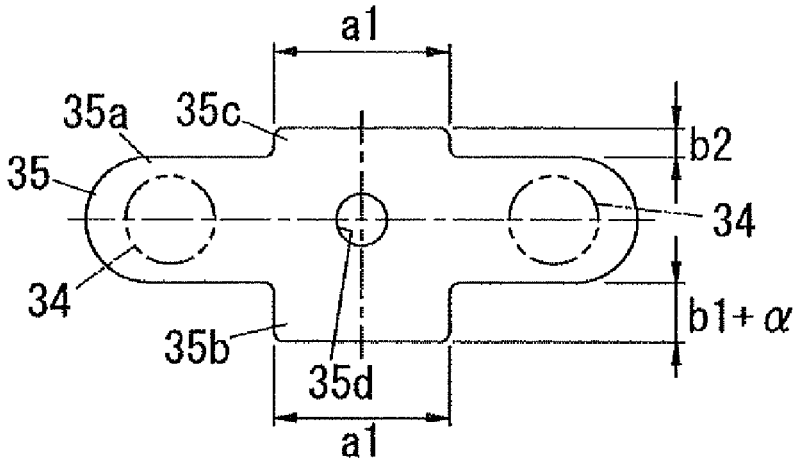
FIG. 5A is a plan view showing a still further example of the movable contact member and FIG. 5B is a section view showing the sealing container.
Figure 5B:
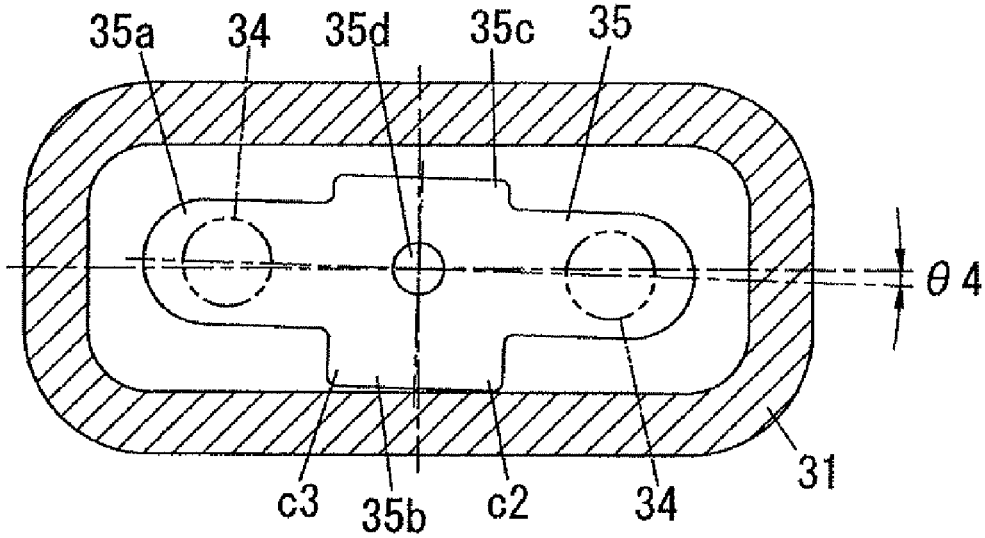

Referring to FIG. 5A which shows a still further example of the movable contact member 35, the protruding length of the protrusion 35*b* is set equal to b1+α which is greater than b1 by α. This further increases the difference between the protruding length of the protrusion 35*b* and the protruding length b2 of the protrusion 35*c*. As shown in FIG. 5B, the rotation angle of the movable contact member 35 when the movable contact member 35 makes contact with the sealing container 31 is set equal to a predetermined angle θ4 which is smaller than θ3. Accordingly, it is possible to reduce the pressing force of the corner portion c2 of the movable contact member 35 acting against the sealing container 31. This further reduces the friction force generated between the protrusion 35*b* and the sealing container 31, thereby enabling the movable contact member 35 to move smoothly and further enhancing the reliability of the switching action between the contact points.

In addition, the weight of the lower portion of the movable contact member 35 positioned below the connection portion of the movable contact member 35 and the shaft 37 becomes even greater than the weight of the upper portion of the movable contact member 35 positioned above the connection portion. Thus, the gravity center of the movable contact member 35 is shifted further downwards along the gravitational force direction. As a result, when the movable contact member 35 vibrates in a state that the contact points are kept in contact with each other, the amplitude of vibration of the movable contact member 35 is further reduced. This makes it possible to further restrain generation of abnormal noises.

Figure 6A:
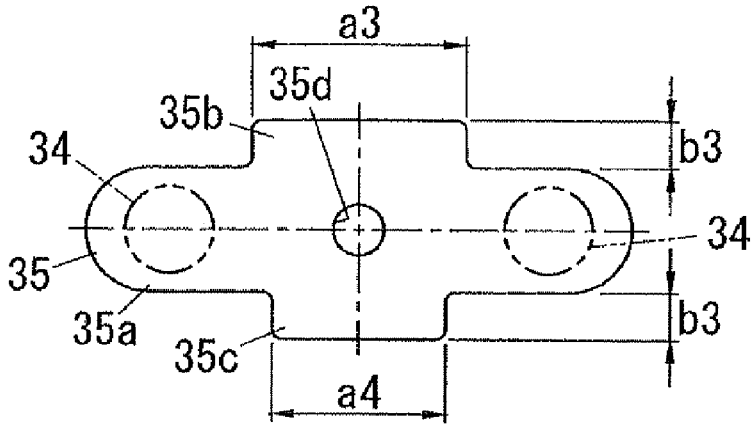
FIG. 6A is a plan view showing a yet still further example of the movable contact member and FIG. 6B is a section view showing the sealing container.
Figure 6B:
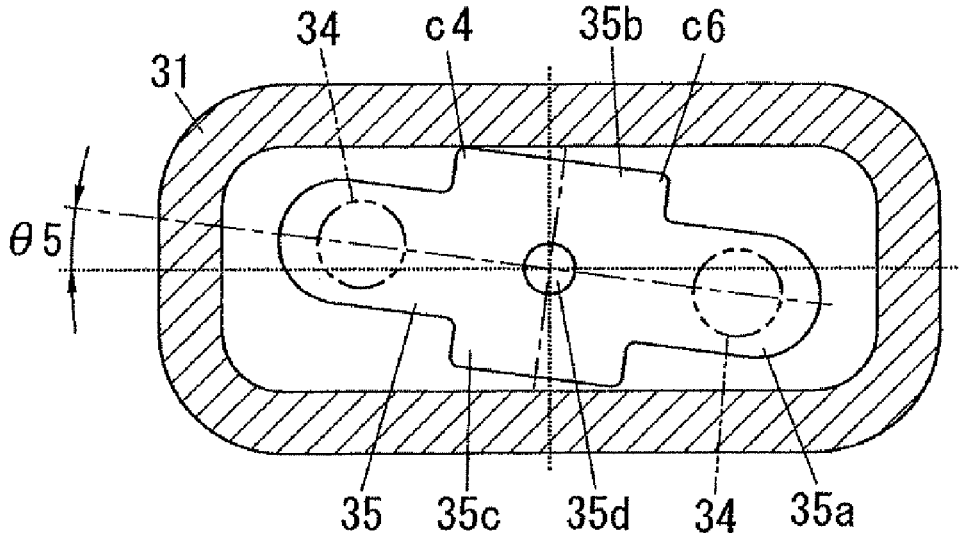
Figure 7A:
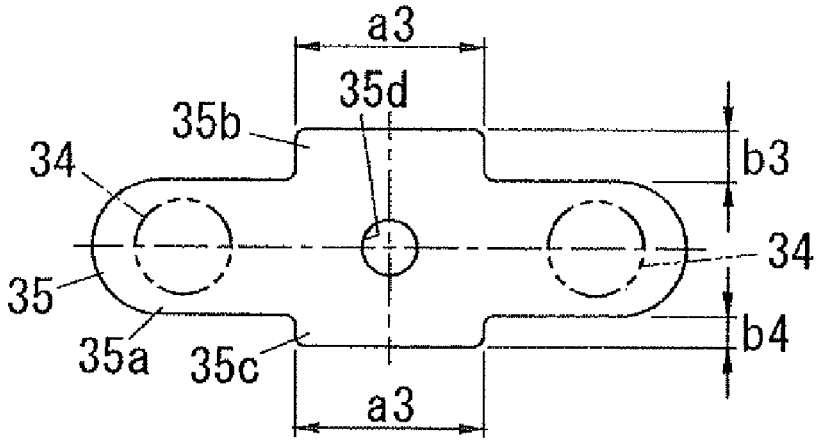
FIG. 7A is a plan view showing an even yet still further example of the movable contact member and FIG. 7B is a section view showing the sealing container.
Figure 7B:
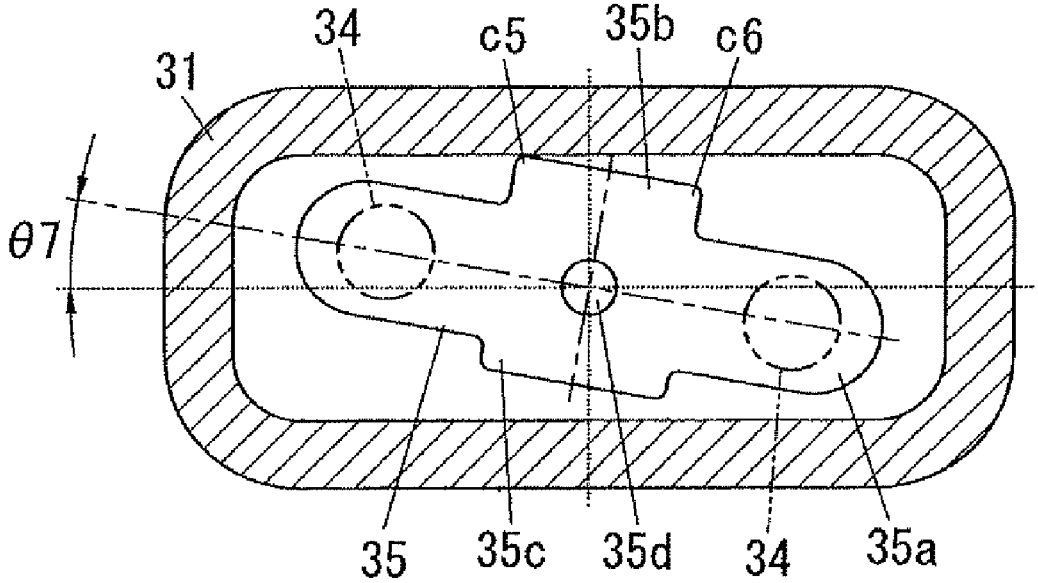

By setting the width a3 of the protrusion 35*b* greater than the width a4 of the protrusion 35*c* as shown in FIG. 6A or by setting the protruding length b3 of the protrusion 35*b* greater than the protruding length b4 of the protrusion 35*c* as illustrated in FIG. 7A, the gravity center of the movable contact member 35 may be shifted upwards along the gravitational force direction to a position higher than the connection portion of the movable contact member 35 and the shaft 37. In this case, it is equally possible to reduce the pressing force of the corner portion c4 or c5 of the movable contact member 35 acting against the sealing container 31. This further reduces the friction force generated between the protrusion 35*b* and the sealing container 31, thereby enabling the movable contact member 35 to move smoothly and further enhancing the reliability of the switching action between the contact points.

In the present embodiment, there is illustrated an instance where the pressure contact spring 36 is extended. However, even if the pressure contact spring 36 is retracted so that the movable contact member 35 can be rotated counterclockwise under the winding torque of the pressure contact spring 36, only the right corner portion c3 of the protrusion 35*b* makes contact with the inner surface of the sealing container 31. Therefore, it is possible to obtain the advantageous effects mentioned above.

In the present embodiment, the winding direction of the pressure contact spring 36 is counterclockwise. However, the winding direction is not limited thereto but may be clockwise.

In the present embodiment, there is illustrated an instance where the protrusions 35*b* and 35*c* differ from each other in only one of the width and the protruding length. Alternatively, the protrusions 35*b* and 35*c* may differ from each other in both of the width and the protruding length, as long as only the corner portion of one of the protrusions 35*b* and 35*c* makes contact with the inner surface of the sealing container 31.

What is claimed is:

1. A sealed contact device, comprising:

an electromagnet block including a hollow cylindrical coil bobbin made of an insulating material and wound with an exciting coil, a movable iron core arranged inside the coil bobbin to axially move within the coil bobbin upon energization and de-energization of the exciting coil, a yoke arranged to form a magnetic circuit and including a first yoke plate having an insertion hole and facing one axial end of the coil bobbin, a second yoke plate facing the other axial end of the coil bobbin and a third yoke plate interconnecting the first yoke plate and the second yoke plate, and a return spring arranged inside the coil bobbin to bias the movable iron core toward the second yoke plate;

a contact block including a sealing container made of an insulating material and air-tightly jointed to the first yoke plate, fixed contact points arranged within the sealing container, a movable contact member arranged within the sealing container and including a substantially rectangular body portion, first and second protrusions formed in longitudinal sides of the body portion and movable contact points for making movement toward and away from the fixed contact points, a pressure contact spring interposed between the movable contact member and the first yoke plate to bias the movable contact member toward the fixed contact points, and a shaft movably extending through the first yoke plate, the shaft being connected to the movable contact member at one end and to the movable iron core at the other end to move the movable contact member toward the fixed contact points in accordance with the movement of the movable iron core; and a case made of an insulating material and arranged to accommodate an inner block including the electromagnet block and the contact block combined together, wherein the first and second protrusions of the movable contact member are formed in non-point symmetry with respect to a connection portion of the movable contact member and the shaft so that, when the movable contact member is rotated, only one of the first and second protrusions makes contact with the sealing container.

2. The device of claim 1, wherein the movable contact member has a gravity center positioned below the connection portion of the movable contact member and the shaft in a gravitational force direction.

3. The device of claim 2, wherein the first and second protrusions are shaped and sized so that only the first protrusion makes contact with the sealing container, the gravity center of the movable contact member being positioned in the first protrusion, the first protrusion being arranged below the connection portion of the movable contact member and the shaft in the gravitational force direction.

4. The device of claim 1, wherein the first protrusion is greater in width than the second protrusion.

5. The device of claim 4, wherein the width of the first protrusion is set to ensure that, when the movable contact member is rotated at a predetermined angle, the first protrusion makes contact with the sealing container.

6. The device of claim 1, wherein the first protrusion is greater in protruding length than the second protrusion.

7. The device of claim 6, wherein the protruding length of the first protrusion is set to ensure that, when the movable contact member is rotated at a predetermined angle, the first protrusion makes contact with the sealing container.

* * * * *